US005170741A

United States Patent [19]

Magers et al.

[11] Patent Number: 5,170,741

[45] Date of Patent: Dec. 15, 1992

[54] REMOVABLE CASTING DECK INSERT FOR A BASS BOAT

[75] Inventors: Mark S. Magers; Guy K. Long, both of Lebanon, Mo.

[73] Assignee: Outboard Marine Corporation, Waukegan, Ill.

[21] Appl. No.: 808,156

[22] Filed: Dec. 13, 1991

[51] Int. Cl.[5] ..... B63B 3/48

[52] U.S. Cl. ..... 114/364; 114/85

[58] Field of Search ..... 114/343, 363, 364, 85, 114/361

[56] References Cited

U.S. PATENT DOCUMENTS 3,376,586 4/1968 Forsyth et al. ..... 114/361

4,293,967 10/1981 Ord ..... 114/85 X

*Primary Examiner*—Sherman Basinger

*Attorney, Agent, or Firm*—Welsh & Katz, Ltd.

[57] ABSTRACT

A casting deck insert unit is disclosed, which is a sturdily constructed, generally box-shaped planar structure shaped and dimensioned to be closely received in and essentially cover the walk-through area in the bow of a bass boat. The unit has an upper surface deck plate which, in its inserted position, is flush with the upper surface of the elevated forward fishing deck and the upper surfaces of the storage compartment structures which are positioned on opposite sides of the walk-through area. Disposed in this manner in the walk-through area, the deck insert unit significantly increases the elevated deck area at the bow of the bass boat. The additional "walk around" area provided by the unit affords the bow fisherman much greater mobility around the front elevated area, and it enables both bass fisherman to comfortably utilize the front casting deck area, if desired. In the event that three fisherman are using the bass boat, two fisherman can comfortably use the extended front elevated deck area, while the third fisherman uses the rear elevated deck portion in the stern of the bass boat.

24 Claims, 2 Drawing Sheets

REMOVABLE CASTING DECK INSERT FOR A BASS BOAT

BACKGROUND OF THE INVENTION

The present invention relates generally to boating devices, and more particularly provides a removable, casting deck unit which is positionable in the walk-through passage area between the control console and the elevated forward deck area in a bass boat to considerably increase the elevated fishing platform area at the bow end of the boat.

In recent years, specialized fishing craft known as "bass boats" have become extremely popular with both professional and amateur fresh water bass fisherman. The typical bass boat is generally provided with a centrally positioned control console disposed between elevated bow and stern fishing and casting deck portions. These two elevated deck portions are each typically provided with pedestal-type fishing chairs to add to the comfort of a day's fishing expedition. Extending forwardly from adjacent the control console to the forward elevated deck portion, and flanked by raised storage compartment structures, is a "walk-through" area which extends along the floor of the boat.

While bass boats of this general configuration have proven to be quite well suited to their rather specialized purpose, they are subject to one primary limitation — namely, the two elevated deck portions each are designed and sized to comfortably accommodate only one fisherman. A normal mode of using a bass boat of this type during fishing is to move the boat forwardly along a shore line area or other suitable fishing structure, by means of a bow-mounted electric motor operated by the forward fisherman, while each fisherman makes a series of casts toward the particular fishing structure.

The somewhat limited total elevated fishing deck area built into the conventional bass boat typically results in the necessity of a third fisherman utilizing the less desirable non-elevated deck portion of the boat. Additionally, it is rather well known that, particularly in tournament fishing, the bow angler has somewhat of an advantage over the angler in the stern due to the fact that the bow angler has, in effect, the first "shot" at prime casting targets which he may cover thoroughly before the stern angler has a chance to cast to them. Additionally, the bow angler has a further advantage due to his control of the overall movement and positioning of the boat during fishing. He may thus (either intentionally or inadvertently) position and guide the boat to his advantage and to the stern angler's disadvantage.

It is accordingly an object of the present invention to eliminate these disadvantages and limitations commonly associated with conventional bass boats of the general configuration described above.

SUMMARY OF THE INVENTION

In carrying out principles of the present invention, in accordance with a preferred embodiment thereof, a removable casting deck insert is provided which may be simply mounted into the forward walk-through area of a bass boat to significantly increase the area of its forward elevated fishing deck area.

The casting deck insert unit is basically a sturdily constructed, generally box-shaped planar structure which is dimensioned to be closely received in and essentially cover the walk-through area. The unit has an upper surface deck plate which, in its inserted position, is flush with the upper surface of the elevated forward fishing deck and the upper surfaces of the storage compartment structures which are positioned on opposite sides of the walk-through area. Disposed in this manner in the walk-through area, the deck insert unit significantly increases the elevated deck area at the bow of the boat. The additional "walk around" area provided by the unit affords the fisherman much greater mobility around the front elevated area, enabling both partners to comfortably utilize the front casting deck area. Additionally, of course, in the event that three fisherman are using the boat, two fisherman can comfortably use the extended front elevated deck area, while the third fisherman uses the rear elevated deck portion.

The deck insert unit also affords additional storage space underneath the now-extended deck for tackle boxes, life jackets or other equipment, if such additional storage space is desired. The unit may be quickly removed from its position within the walk-through space when desired to return the boat to its conventional two-person fishing layout. Because of its planar structure, the deck insert unit may be easily stored on the boat when not in use.

DETAILED DESCRIPTION

Figure 1:
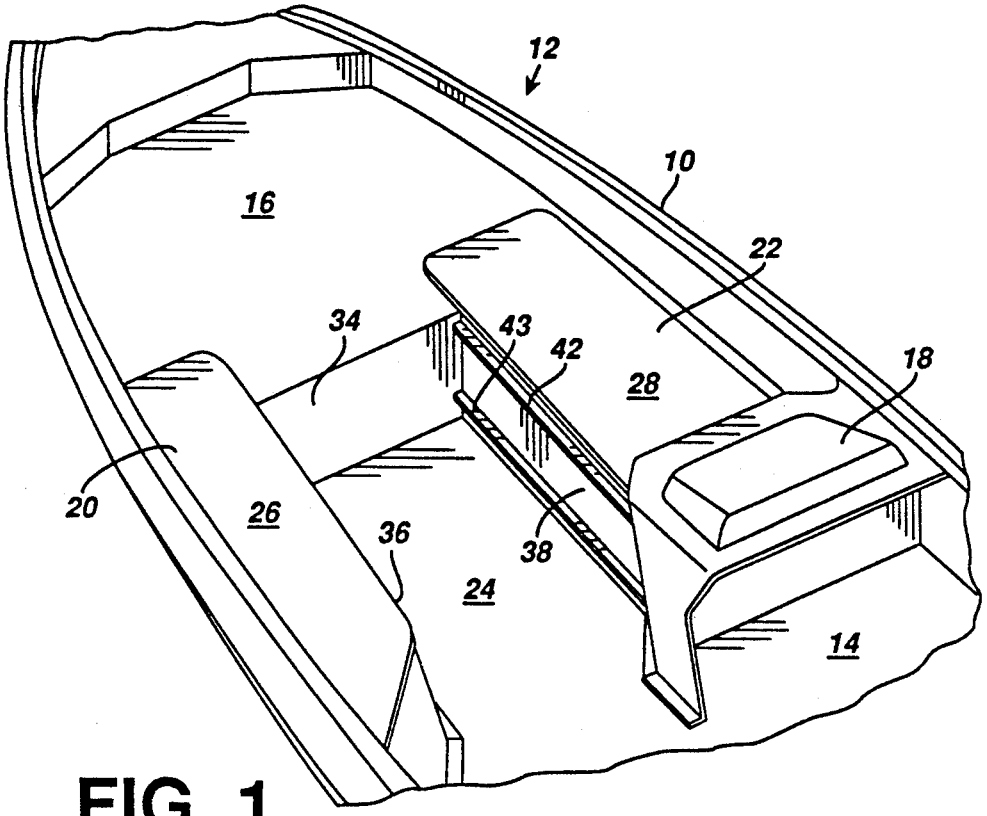
FIG. 1 is a perspective view of the bow portion of a typical bass boat, showing the open walk-through area without the removable casting deck insert of the present invention, but showing supporting side rails therefore.

Perspectively illustrated in FIG. 1 is a bow portion 10 of a bass boat 12 having a floor 14, an elevated fishing deck area 16 positioned at the forward end of the bow portion 10, and a control console 18 positioned rearwardly of the elevated deck 16 on the right side of the boat. Extending laterally inwardly from the opposite sides of the boat between the elevated deck area 16 and the console 18 are a pair of elevated storage locker units 20 and 22 which define therebetween a downwardly offset "walk-through" space or passage above floor area 24 which extends along the boat floor 14 from adjacent the console 18 to the elevated deck area 16. The floor area 24 is confined by a front wall 34, a left sidewall 36, and a right sidewall 38. Sidewall 38 has mounted thereon the side support rails 42 and 43 of the present invention, which will be fully discussed hereinafter. The lockers 20, 22 are respectively provided with hinged lid portions 26 and 28 which may be pivoted upwardly to open the lockers for storage of various fishing and other equipment therein. With the lids 26, 28 in their closed position illustrated in FIG. 1, their upper surfaces are flush with the upper surface of the elevated deck area 16 and define relatively narrow rearward extensions thereof.

In a conventional bass boat, similar to the inventive bass boat 12 illustrated in FIG. 1, the total area of the elevated deck area 16 is relatively small and provides a comfortable fishing platform for only one angler. A similar elevated deck area (not shown) is also provided at the stern of the boat. Each of these two elevated deck areas are typically provided with a removable, pedestal fishing chair for use by the single fisherman on each of the two deck areas. Thus, bass boats of the conventional construction, similar to the boat depicted in FIG. 1, provide desirable elevated casting areas for only two anglers.

To provide additional front elevated fishing deck area on the boat, the present invention uniquely provides a removable, casting deck insert unit 60 which may be easily and quickly inserted into the walk-through area 24 to, in effect, rearwardly extend the forward elevated deck area 16.

Figure 2:
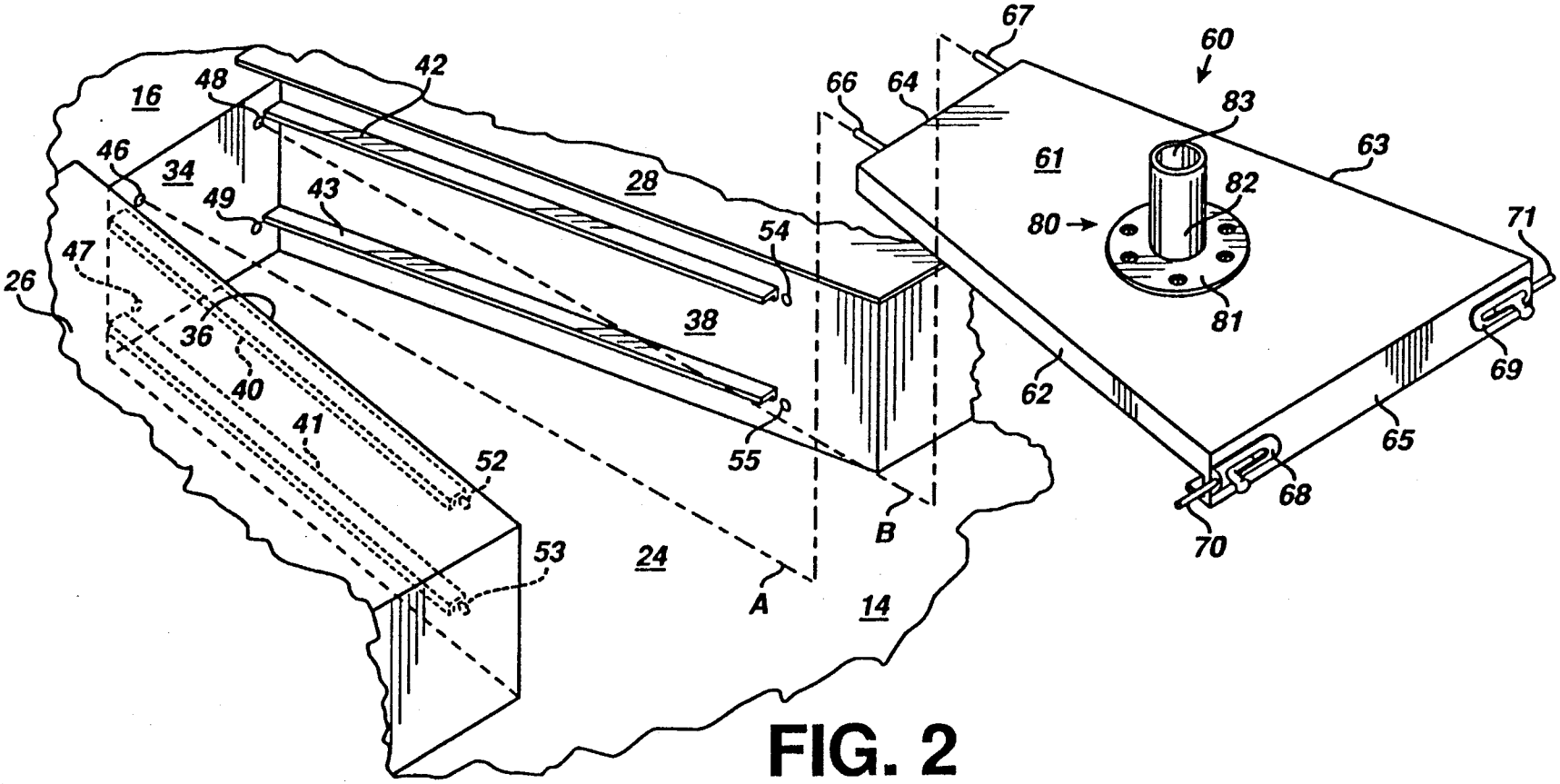
FIG. 2 is a simplified schematic representation of the walk-through area of FIG. 1, shown in perspective, with the deck insert unit shown ready for insertion to provide additional casting deck surface.

Referring now to FIG. 2, it will be seen that the casting deck insert unit 60 has a generally box-like, but planar, configuration. The configuration of the unit 60 is such as to provide a tight fit at the height of the casting deck area 16 in the walk-through space or passage above the floor area 24. As shown in FIG. 1, the floor area 24 is rectangular in shape, while it has a trapezoidal shape in FIG. 2. This illustrates that the casting deck insert unit 60 will have whatever shape is necessary to conform to the shape of the walk-through passage for the specific design of the bass boat 12.

Referring again to FIG. 2, the bass boat has an upper left side support rail 40 and a lower left side support rail 41 mounted on the left sidewall 36, while an upper right side support rail 42 and a lower right side support rail 43 are mounted on the right sidewall 38. The upper side support rails 40 and 42 are mounted on the sidewalls 36 and 38, respectively, at a first dimension below the upper surface of the deck area 16 and the hinged lids 26 and 28. The side support rails may have the general structure of an angle iron, as shown most clearly in FIG. 2, with an upper planar surface upon which the deck insert unit 60 may rest. A left upper forward pinhole 46 and a left lower forward pinhole 47 are located in the front wall 34 of the walk-through floor area 24. In addition, a right upper forward pinhole 48 and a right lower forward pinhole 49 are also located in the front wall 34. A left upper rear pinhole 52 and a left lower rear pinhole 53 are positioned in the left sidewall 36, while a right upper rear pinhole 54 and a right lower rear pinhole 55 are positioned in the right sidewall 38.

The casting deck insert unit 60 has a surface deck plate 61, a left sidewall 62, a right sidewall 63, a forward sidewall 64, and a rear sidewall 65. It is to be noted that the sidewalls 62, 63 and 64 of the deck insert unit have a height which is equal to the first dimension at which the side support rails 40 and 42 are mounted below the surface of elevated deck 16 and hinged lids 26 and 28 on sidewalls 36 and 38, respectively. A left forward locating pin 66 and a right forward locating pin 67 extend beyond the forward sidewall 64. Left rear retractable locking pin assembly 68 and right rear retractable locking pin assembly 69 are mounted on the rear sidewall 65. The left rear retractable locking pin assembly has a left rear locking pin 70 extending therefrom while the right rear retractable locking pin assembly 69 has a right rear locking pin 71 extending therefrom. The retractable locking pins 70 and 71 may be moved from an extended position to a retracted position by means of a handle which is mounted on each locking pin so that the pin is movable by shifting the handle along a slot within the pin assembly. The pin assemblies 68 and 69 may also contain compression springs, not shown, which keep the corresponding locking pins 70 and 71 in the extended position, shown in FIG. 2, so that the locking pin assemblies 68 and 69 provide for an assured locking of the casting deck insert unit 60 in the elevated position above the floor 24. Such an embodiment for the locking pin assemblies assures that the deck insert unit 60 will remain secured in position until manual intervention intentionally unlocks the unit by retracting the pins against the biasing springs.

The long dashed lines A and B show that the casting deck insert unit 60 is inserted into the walk-through space or passage above the floor area 24 by being mounted on the upper side support rails 40 and 42 and slid thereon until the locating pins 66 and 67 penetrate into the corresponding upper forward pinholes 46 and 48, respectively. When this occurs, the locking pins 70 and 71 will pass into the upper locking pinholes 52 and 54, respectively. This positions and retains the casting deck insert unit 60 in a secured locked position to provide the rearward extension of the forward elevated deck area 16.

The upper surface of the deck plate 61 has a deck surface fixture 80, mounted thereon by means of a mounting flange 81, for receiving and securing the bottom end of a supporting column or shaft of a pedestal-type of fisherman's chair. The deck surface fixture 80 has an upwardly extending collar 82 having a central bore 83 for receiving the bottom end of the supporting column or shaft of the fisherman's chair. Bore 83 is closed at its bottom end in order to support the chair. In an alternate embodiment, which is a preferred embodiment, the collar is a depending collar 84 (FIG. 3) which extends downwardly from the flange 81 mounted on the upper surface of the deck plate 61 so that the bore 83 is below the surface of plate 61. In this embodiment the bottom end of the supporting column or shaft of the fisherman's chair also will be contained within the bore 83. The advantage of the depending fixture is that it does not establish a tripping hazard when the fisherman's chair has been removed from the bore 83.

Figure 3:
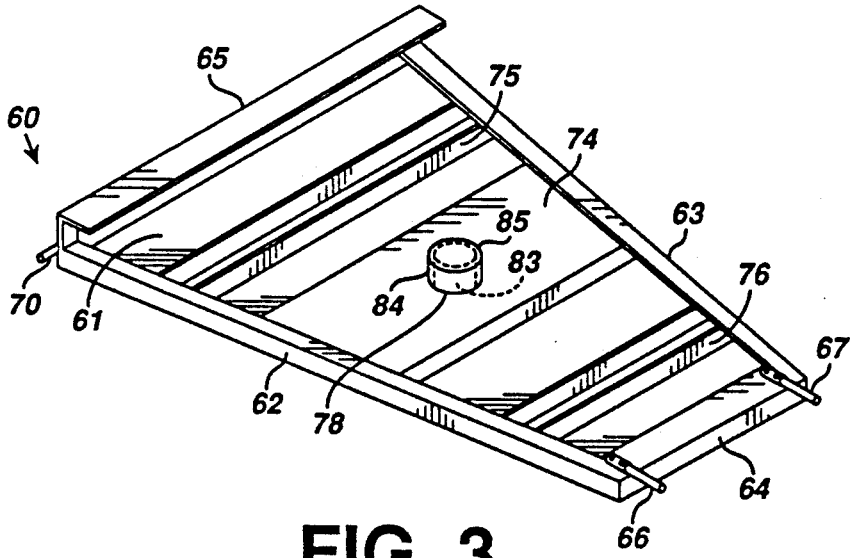
FIG. 3 is a schematic perspective view of the deck insert unit of FIG. 2, with the deck insert unit being upside down to show the support structure on the underside of the deck insert unit.

FIG. 3 illustrates a perspective view of the underside structure for the casting deck insert unit 60, showing the lower surface of deck plate 61. It will be seen that the left sidewall 62, the right sidewall 63, the forward sidewall 64, and the rear sidewall 65 have a bent over lip to provide structural strength and longitudinal rigidity. In addition, the bottom side of the casting deck insert unit 60 has a central deck support member 74 which is a heavy plate-like member containing an aperture 78 for receiving a depending collar 84, which extends through aperture 78 from a flange 81 (not shown) mounted on the upper surface of the deck plate 61. The depending collar 84 has a closed bottom end 85, which does not extend beyond the bent over lip of rear sidewall 65, for a reason disclosed hereinafter.

The thick plate-like central deck support member 74 provides a stiffening weight-bearing area which is capable of supporting the pedestal-type of fisherman's chair with a fisherman seated in the chair. Additional structural support for the deck plate 61 is also provided by a rear deck support member 75 and a front deck support member 76. Preferably, the deck support members 75 and 76 are channel irons having a structural thickness sufficient to provide support for a fisherman walking upon the upper surface of the deck plate 61. The central web of the channel irons 75 and 76 is butted against the bottom surface of the deck plate 61.

When the casting deck insert unit 60 is no longer needed to provide the rearwardly extending portion of the forward elevated deck area 16 above the floor area 24, it may be removed from its upper position on the side rails 40 and 42. To provide for efficient storage, the casting deck insert unit 60 may then be slid along the lower side support rails 41 and 43 so that the locking pins 66 and 67 enter the lower forward pinholes 47 and 49 in the front wall 34 above the walk-through floor area 24. Note that side support rails 41 and 43 are located slightly above the floor 24 in order to compensate for the extra height of the rear sidewall 65 of insert unit 60. At the same time, the locking pins 70 and 71 will enter into the lower rear pinholes 53 and 55 to lock the casting deck insert unit 60 in a stored position adjacent the floor area 24. At this point, the walk-through space or passage above the floor area 24 once again becomes open and available for the fishermen to walk along, as when they wish to open the storage compartment lids 26 and 28, but they will now be walking on the stored deck insert unit 60. The reason for limiting the length of the depending collar 84 so that the closed bottom end 85 does not extend beyond the bent over lip of rear sidewall 65 now becomes apparent, since a greater length of collar 84 would interfere with proper placement of the casting deck insert unit 60 in the stowed position adjacent the floor area 24.

Thus, it can be readily appreciated that the casting deck insert unit of the present invention eliminates the disadvantages and the limitations commonly found in conventional bass boats of the general configuration found in the prior art. The casting deck insert unit 60 may be easily and quickly inserted into the walk-through area 24 to rearwardly extend the forward elevated deck area 16 when required. When the casting deck insert unit 60 is inserted in the elevated position, the space between the insert unit 60 and the floor 24 provides a convenient temporary storage space for fisherman's equipment and clothing. When the extended elevated deck area is no longer needed for fishing purposes, the casting deck insert unit 60 may be easily and quickly removed from the elevated position and inserted into the walk-through area 24 at the lower position to provide a flooring for the walk-through passage while it is being stored.

Although the present invention has been described with preferred embodiments illustrated herein, it is to be understood that modifications and variations may be resorted to without departing from the spirit and scope of this invention, as those skilled in the art will readily understand. Such modifications and variations are considered to be within the purview and the scope of the appended claims.

What is claimed is:

1. A boat, suitable for use in fishing for bass, which comprises:

a boat hull having two sides, a bow end and a stern end;

an elevated deck positioned at the bow end of said hull;

a pair of elevated side structures extending rearwardly from said elevated deck along opposite sides of said hull and defining therebetween a downwardly offset walk-through passage area having a floor bounded at its inner end by a front wall at said elevated deck and at its opposite sides by right and left sidewalls, said elevated structures having upper surfaces defining horizontally rearward extensions of the upper surface of said elevated deck;

at least one side support means on each of said right and left sidewalls positioned slightly below the upper surfaces of said elevated side structures and said elevated deck;

a removable deck insert unit having an upper surface of a size and shape conforming with the size and shape of the upper region of said walk-through passage area, said deck insert unit being insertable to rest upon said side support means to cover said walk-through passage area and provide its upper surface at substantially the same elevation as the upper surfaces of said elevated side structures and said elevated deck; and said removable deck insert unit having a forward sidewall which is matable with the upper region of the front wall of the walk-through passage area, said forward sidewall having at least one locating element, and said upper region of the front wall having at least one positioning element for mating with said locating element when said forward sidewall is butted against said front wall upon installation of said removable deck.

2. A boat according to claim 1 wherein said forward sidewall has a locating element adjacent each of its ends, said upper region of said front wall having two positioning elements for mating with said two locating elements.

3. A boat according to claim 1 wherein said forward sidewall is matable with the lower region of the front wall of the walk-through passage area, said lower region of the front wall having at least one positioning element for mating with said locating element when said forward sidewall is butted against the lower region of said front wall upon installation of said removable deck insert unit with its upper surface below said elevated fishing deck and proximate to but slightly above the floor of said walk-through passage area.

4. A boat according to claim 3 wherein at least one side support means is mounted on each of the right and left sidewalls of the walk-through passage area proximate said passage area floor for supporting said removable deck insert unit upon installation with its upper surface proximate to and slightly above said floor.

5. A boat according to claim 1 wherein at least one side support means is mounted on each of the right and left sidewalls of the walk-through passage area proximate said passage area floor for supporting said removable deck insert unit with its upper surface proximate to and slightly above said floor.

6. A boat according to claim 1 wherein said side support means comprise an elongated longitudinal side support rail mounted along at least a portion of the length of each of said right and left sidewalls of the walk-through passage area.

7. A boat according to claim 1 further including means for securing said removable deck insert unit in position when it has been installed to cover said walk-through passage area.

8. A boat according to claim 7 wherein said deck insert unit has a rear sidewall and said securing means comprises a locking element on each end of said rear sidewall, said right and left sidewalls of the walk-through passage area containing receiving elements matable with corresponding locking elements to secure said deck insert unit in place.

9. A boat according to claim 1 wherein said removable deck insert unit includes a fixture on the planar upper surface for receiving and supporting a fisherman's chair.

10. A boat, suitable for use in fishing for bass, which comprises:

a boat hull having two sides, a bow end and a stern end;

an elevated deck positioned at the bow end of said hull;

a pair of elevated side structures extending rearwardly from said elevated deck along opposite sides of said hull and defining therebetween a downwardly offset walk-through passage area having a floor bounded at its inner end by a front wall at said elevated deck and at its opposite sides by right and left sidewalls, said elevated structures having upper surfaces defining horizontally rearward extensions of the upper surface of said elevated deck;

at least one side support means on each of said right and left sidewalls positioned at a first dimension slightly below the upper surfaces of said elevated side structures and said elevated deck;

a removable deck insert unit having a planar upper surface of a size and shape conforming with the size and shape of the upper region of said walk-through passage area and having a thickness equal to said first dimension, said removable deck insert unit having a forward sidewall and a rear sidewall, said deck insert unit being slidably insertable to rest upon said side support means to cover said walk-through passage area and provide its planar upper surface at substantially the same elevation as the upper surfaces of said elevated side structures and said elevated deck;

said forward sidewall of said removable deck insert unit being matable with the upper region of the front wall of the walk-through passage area, said forward sidewall having at least one outwardly extended locating element, and said upper region of the front wall having at least one inwardly recessed receiving element positioned for mating with said extended locating element when said forward sidewall is butted against said front wall upon installation of said removable deck insert unit; and a locking element on each end of said rear sidewall of said deck insert, said right and left sidewalls of the walk-through passage area having receiving elements matable with said locking elements to secure said deck insert unit in place.

11. A boat according to claim 10 wherein said forward sidewall has an outwardly extended locating element adjacent each of its ends, said upper region of said front wall having two inwardly recessed receiving elements positioned for mating with said two extended locating elements.

12. A boat according to claim 10 wherein said forward sidewall is matable with the lower region of the front wall of the walk-through passage area, said lower region of the front wall having at least one inwardly recessed receiving element for mating with said extended locating element when said forward sidewall is butted against the lower region of said front wall upon installation of said removable deck insert unit with its upper surface below said elevated deck and proximate to but slightly above the floor of said walk-through passage area.

13. A boat according to claim 12 wherein said installation positions the upper surface of the deck insert unit above said floor by about said first dimension.

14. A boat according to claim 12 wherein at least one side support means is mounted on each of the right and left sidewalls of the walk-through passage area at a second dimension above said passage area floor for supporting said removable deck insert unit upon installation with its upper surface proximate to and slightly above said floor.

15. A boat according to claim 10 wherein at least one side support means is mounted on each of the right and left sidewalls of the walk-through passage area floor for supporting said removable deck insert unit with its upper surface proximate to and slightly above said floor.

16. A boat according to claim 10 wherein said side support means comprise an elongated longitudinal side support rail mounted along at least a portion of the length of each of said right and left sidewalls of the walk-through passage area.

17. A boat according to claim 10 further including means for securing said removable deck insert unit in position when it has been installed to cover said walk-through passage area.

18. A boat according to claim 10 wherein said removable deck insert unit includes a fixture on the planar upper surface for receiving and supporting a fisherman's chair.

19. A boat, suitable for use in fishing for bass, which comprises:

a boat hull having two sides, a bow end and a stern end;

an elevated deck positioned at the bow end of said hull;

a pair of elevated side structures extending rearwardly from said elevated deck along opposite sides of said hull and defining therebetween a downwardly offset walk-through passage area having a floor bounded at its inner end by a front wall at said elevated deck and its opposite sides by right and left sidewalls, said elevated structures having upper surfaces defining horizontally rearward extensions of the upper surface of said elevated deck;

a removable deck insert having an upper surface of a size and shape conforming with the size and shape of the upper region of said walk-through passage area, said deck insert having a forward sidewall which is matable with the upper region of the front wall of the walk-through passage area, said forward sidewall having at least one locating element, and said upper region of the front wall having at least one positioning element for mating with said locating element when said forward sidewall is butted against said front wall;

side support means on each of said right and left sidewalls for selectively positioning said deck insert between at least a first position and a second position to cover said walk-through area;

said first position being slightly below the upper surfaces of said elevated side surfaces and said elevated deck to support said upper surface of said deck insert at substantially the same elevation as said upper surfaces of said elevated side structures and said elevated deck; and said second position being proximate said passage area floor for supporting said deck insert upon installation with its upper surface proximate to and slightly above said floor.

20. A boat according to claim 19 wherein said forward sidewall has a locating element adjacent each of its ends, said upper region of said front wall having two positioning elements for mating with said two locating elements.

21. A boat according to claim 19 wherein said side support means comprise an elongated longitudinal side support rail mounted along at least a portion of the length of each of said right and left sidewalls of the walk-through passage area.

22. A boat according to claim 19 further including means for securing said removable deck insert unit in position when it has been installed to cover said walk-through passage area.

23. A boat according to claim 22 wherein said deck insert unit has a rear sidewall and said securing means comprises a locking element on each end of said rear sidewall, said right and left sidewalls of the walk-through passage area containing receiving elements matable with corresponding locking elements to secure said removable deck insert unit in place.

24. A boat according to claim 19 wherein said removable deck insert unit includes a fixture on the planar upper surface for receiving and supporting a fisherman's chair.

* * * * *